United States Patent [19]

Barwin

[11] 4,175,766

[45] Nov. 27, 1979

[54] SKI EDGE

[76] Inventor: Raymond K. Barwin, 14463 Twelve Mile Rd., Apt. D, Warren, Mich. 48093

[21] Appl. No.: 918,345

[22] Filed: Jun. 23, 1978

[51] Int. Cl.[2] ..... A63C 5/04
[52] U.S. Cl. ..... 280/608
[58] Field of Search ..... 280/609, 610, 608

[56] References Cited

U.S. PATENT DOCUMENTS

| | | | |
|---|---|---|---|
| 2,694,580 | 11/1954 | Head | 280/610 |
| 3,295,859 | 1/1967 | Perry | 280/601 |

FOREIGN PATENT DOCUMENTS

| | | | |
|---|---|---|---|
| 138879 | 9/1934 | Austria | 280/608 |
| 771195 | 7/1934 | France | 280/608 |
| 288462 | 5/1953 | Switzerland | 280/608 |

*Primary Examiner*—Joseph F. Peters, Jr.
*Assistant Examiner*—Milton L. Smith
*Attorney, Agent, or Firm*—Basile and Weintraub

[57] ABSTRACT

A ski edge has an undercut or hollow forming an inner wall providing greater control and edge grip while skiing particularly on hard snow or ice when executing a turn or stopping. The undercut also provides an edge which retains its grip or "bite" by remaining sharp many times longer than conventional edges.

6 Claims, 3 Drawing Figures

SKI EDGE

Field of the Invention

The present invention relates generally to the field of skis for traveling over snow, and in particular to an improved outer edge for skis.

Description of the Prior Art and Prior Art Statement

U.S. Pat. No. 3,295,859 constitutes the only prior art the applicant has discovered relating to the subject invention. U.S. Pat. No. 3,295,859 relates to an all metal ski of the "shortie" type wherein deep grooves along the edges are used to substitute for the conventional single groove along the center of the conventional ski.

SUMMARY OF THE INVENTION

The present invention which will be described subsequently in greater detail, comprises a metal ski edge having a bottom surface that is angled or curved in relation to its outer wall resulting in an undercut or relief on the bottom surface adjacent the edge. One object of the present invention is to produce a ski having an inner wall adjacent the outer edge which gives the ski greater gripping action when turning or stopping particularly on hard snow or ice. Another object of the present invention is to have a ski which retains its sharp edge for a much longer period of time. The present invention is applicable to any edge used in conjunction with a conventional ski including the so called "Hidden Steel Edge" type which is widely used in conjunction with laminated reinforced plastic skis.

A relief or undercut can be added to skis which already have the edges attached by machining or grinding a one-sixteenth inch radius along the length of the exposed steel edge. The undercut is particularly useful when employed the full length of the steel edges excluding the very tip and tail posture. Substantial improvement in the grip or bite of the edges can be realized by using partial or separate undercuts of varied length and numerous amounts along the bottom of the skis steel edges.

Experience has shown that for skis with a "Hidden" edge, the use of a one-sixteenth inch radius approximately one-sixtyfourth of an inch deep produces the optimum configuration. The depth of one-sixtyfourth of an inch can be increased or decreased slightly, however a depth of one-thirtysecond of an inch was found to produce a channel which caused the ski to drag as snow would build up in the channel.

An increase or decrease in the radius and depth will greatly change the amount of edge grip, and changes may be desired for different individuals or skiers or skiiing conditions.

The undercut or relief on the edges produces a slight lip that bites into the snow or ice when a "carved" turn is being executed. The present invention increases the bottom side surface are a that comes in contact with the ice or hard snow when executing a "carved" turn thereby increasing the "bite". The present invention also helps beginners and experts by reducing side slip thereby preventing falls at slow as well as high speeds.

Experience has shown that in conventional skis having metal edges the optimum groove has a depth of approximately one-fourth the exposed width of the edge.

As has been pointed out above, skis with their edges already attached can be modified to produce the desired configuration. The desired edge cross sections can be formed by rolling, extruding, grinding or machining before or after assembly of the edges to the skis.

Other objects, advantages and applications of the present invention will become apparent to those skilled in the art of skis when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numbers refer to like parts throughout the several views, and wherein.

DESCRIPTION OF THE PREFERRED EMBODIMENT

Figure 1:
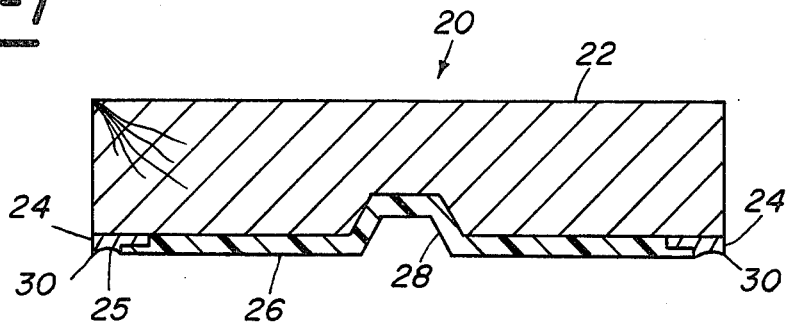
FIG. 1 is a cross-sectional view of a conventional ski with hidden steel edges that have been modified in accordance with the present invention.

Referring now to the drawing and, in particular to FIG. 1 wherein there is illustrated one embodiment of the present invention in the form of ski 20 having an upper structural member 22 and hidden non-linear steel edges 24. Steel edges have been hollow ground along their skiing surface producing an inner wall 25 adjacent the outer edge 30 with an included angle of less than ninety degrees.

The hollow ground defines the inner wall 25 and a more prominent edge adjacent the outer wall of the ski edge which provides an increased surface area at the edge contact area for gripping the snow when the ski is used in turns and for stopping. Plastic surface 26 partially covers the edge and helps retain it in place; while a snow groove 28 runs lengthwise of the ski in a conventional manner at its center to give control in soft snow.

Figure 2:
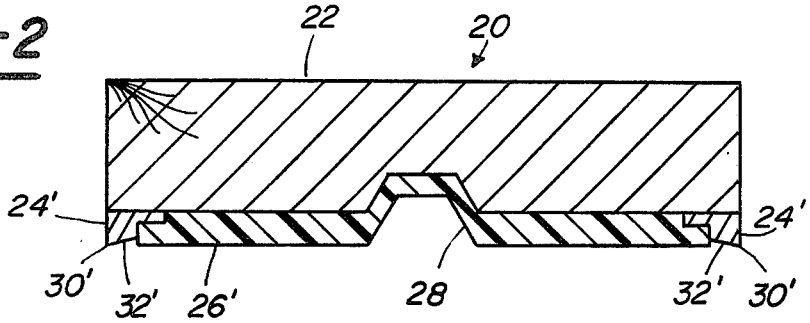
FIG. 2 illustrates a second embodiment of the present invention.
Figure 3:
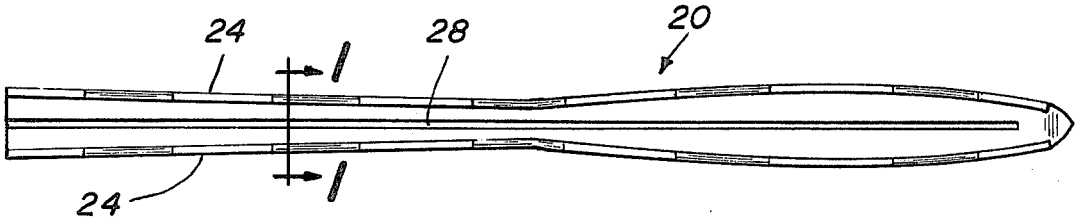
FIG. 3 illustrates a bottom view of a conventional ski with the improved edges attached.

Referring now to FIG. 2 wherein a second embodiment of the present invention is shown. Sharp edge 30' is developed by the lower surface 32'. The lower surface 32' of the edge is flat, and from edge 30' the lower surface 32' extends inwardly and upwardly ending when it meets ski 20. Similar to the hollow ground, the lower surface 32' defines an inner wall adjacent the outer wall of the ski edge which provides an increased surface area at the edge contact area which will function to increase the ski's turning and stopping capability. Experience has shown that the optimum included angle between outer wall 24' and lower surface 26' is approximately 87°. The lower surface 32' may commence at a point immediately adjacent the point 30'.

What is claimed is as follows:

1. A ski for skiiing on snow having an edge member attached to the outer edges of the bottom of said ski, said edge member comprising:

a hidden edge;

a plastic surface attached to the bottom partially covering and retaining the hidden edge;

a plurality of separate and partial undercuts employed along the length of said edge member each undercut forming together with the outer wall of the edge member a lip having an included angle of less than 90 degrees between the outer wall and the bottom surface of the edge member;

said undercuts extending from the lip to the edge of the plastic surface and increasing a surface area of said edge member contacting the snow thereby increasing the bite of the ski when turning on hard snow or ice; and said undercuts omitted at a lip and tail portion of said member.

2. The ski as defined in claim 1 wherein each said undercut has a concave bottom surface.

3. The ski as defined in claim 2 wherein the depth of said concave surface does not exceed one quarter the width of the exposed portion of said edge.

4. The ski as defined in claim 1 wherein the bottom surface of each said undercut is flat, projecting laterally inwardly and upwardly at an angle with respect to said outer wall.

5. The ski defined in claim 4 wherein said bottom surface of each said undercut is at 87° with respect to said outer wall.

6. The ski as defined in claim 1 wherein said edge members are made of metal.

* * * * *